US006943316B2

(12) United States Patent
Konavko et al.

(10) Patent No.: US 6,943,316 B2
(45) Date of Patent: Sep. 13, 2005

(54) ARRANGEMENT FOR GENERATING AN ACTIVE GAS JET

(75) Inventors: Rudolph Konavko, Feldkirchen (DE); Arkady Konavko, Garching (DE); Hermann Schmid, Vaterstetten (DE)

(73) Assignee: TePla AG, Feldkirchen (DE)

( * ) Notice: Subject to any disclaimer, the term of this patent is extended or adjusted under 35 U.S.C. 154(b) by 0 days.

(21) Appl. No.: 10/236,747

(22) Filed: Sep. 6, 2002

(65) Prior Publication Data

US 2003/0047540 A1 Mar. 13, 2003

(30) Foreign Application Priority Data

Sep. 7, 2001 (DE) ..... 101 45 131

(51) Int. Cl.[7] ..... B23K 9/00

(52) U.S. Cl. ..... 219/121.4; 219/121.52; 219/121.56

(58) Field of Search ..... 219/121.11, 121.36, 219/121.48, 121.5, 121.52, 121.59, 121.45, 121.56

(56) References Cited

U.S. PATENT DOCUMENTS

| | | | | |
|---|---|---|---|---|
| 3,042,830 A | | 7/1962 | Orbach | |
| 4,800,716 A | * | 1/1989 | Smith et al. | 60/203.1 |
| 4,882,465 A | * | 11/1989 | Smith et al. | 219/121.48 |
| 5,111,656 A | * | 5/1992 | Simon et al. | 60/203.1 |
| 5,640,843 A | | 6/1997 | Aston | |
| 5,901,551 A | | 5/1999 | Butler | |
| 6,433,298 B1 | * | 8/2002 | Ishii | 219/121.43 |

FOREIGN PATENT DOCUMENTS

| | | |
|---|---|---|
| DE | 39 31 733 A1 | 4/1991 |
| DE | 41 23 153 C2 | 1/1992 |
| DE | 195 32 412 | 3/1997 |
| DE | 195 46 930 | 5/1997 |
| EP | 0 305 241 | 3/1989 |

* cited by examiner

*Primary Examiner*—Thor Campbell
(74) *Attorney, Agent, or Firm*—Reed Smith LLP

(57) ABSTRACT

The invention is directed to an arrangement for generating a chemically active jet (active gas jet) by a plasma generated by electric discharge in a process gas. It is the object of the invention to find a novel possibility for generating a chemically active jet by a plasma generated by electric discharge in which high chemical activity develops at increased process gas velocity of the active gas jet on the surface to be treated and is electrically neutral already at the output of the arrangement, so that it does not pose a threat to the operating personnel, the environment and the treated surface. This object is met in that the discharge chamber has a conically narrowed end for increasing the velocity of the active gas jet, and a limiting channel for preventing propagation of the discharge zone into the free space for the surface to be treated is arranged following the narrowed end of the discharge chamber. The limiting channel is essentially cylindrical and is grounded and its length is greater than its cross section by a factor of 5 to 10.

26 Claims, 7 Drawing Sheets

ARRANGEMENT FOR GENERATING AN ACTIVE GAS JET

CROSS-REFERENCE TO RELATED APPLICATIONS

This application claims priority of German Application No. 101 45 131.8, filed Sep. 7, 2001, the complete disclosure of which is hereby incorporated by reference.

BACKGROUND OF THE INVENTION a) Field of the Invention

The invention is directed to an arrangement for generating a chemically active jet (hereinafter: active gas jet) by means of an electrically generated plasma in a process gas being used. The invention is suited particularly for the treatment of surfaces, e.g., for pretreating and cleaning surfaces prior to gluing, coating or painting, for coating, hydrophilization, removal of electric charges or sterilization and for accelerating chemical reactions.

b) Description of the Related Art

Known arrangements for pretreating surfaces of workpieces by means of a gas which is activated in an electric discharge zone are shown in DE 195 46 930 C1, DE 195 32 412 A1 and EP 03 05 241. In patent DE 195 46 930 C1, a whirling flow of the gas to be activated is guided through an electric discharge zone which is formed between a conical center electrode and a ring electrode located externally at the end of a nozzle.

Another, similar method is described in DE 195 32 412 A1 in which the gas to be activated is initially introduced and activated in a whirling flow in the area of a discharge zone occurring along the axis of a cylindrical nozzle pipe with an internally insulated cylindrical outer electrode and a coaxial center electrode and, at the outlet of the discharge zone at which the nozzle pipe narrows in the form of a circular terminating surface of the cylindrical outer electrode, the gas jet is essentially discharged at the terminating surface of the outer electrode.

The solutions mentioned above are disadvantageous in that the gas jet exiting from the nozzle has a considerable electric potential with a value between the potential of the grounded ring electrode and that of the center electrode. With a correspondingly high throughput of gas through the outlet opening of the gas flow, discharge brushes arch out of the nozzle in the direction of the active gas jet in addition. The disadvantage mentioned above limits possible applications of the two solutions mentioned above a) because of the risk of electric shock for the operating personnel and b) because of the possibility of defects induced by electromagnetic fields during surface treatment of sensitive materials, e.g., semiconductor substrates which may also have doped layers or structures.

According to EP 03 05 241, the gas to be activated is guided directly through an electric discharge zone. The discharge zone is formed in a pipe by means of an electric field, wherein either electrodes are arranged laterally within the pipe successively in the flow direction of the gas or a discharge chamber which is installed in a waveguide and which comprises insulating material without electrodes is provided. This solution has the above-mentioned disadvantage that at a high velocity of the activated gas flow there is a high probability that the electromagnetic fields and the electric discharge zone itself will exit from the discharge chamber in the direction of the active gas jet due to the total absence of a shielding ring electrode at the end of the discharge chamber. The arrangement described in EP 0 305 241 A1 protects operating personnel by means of a separate, closed treatment chamber in which the surface treatment of the material takes place. The resulting complicated conditions for material processing are disadvantageous and, if the protective chamber were omitted, would lead to an uncontrolled change in the process conditions and endangerment of operating personnel.

All of the technical solutions mentioned above are characterized in that the velocity, temperature and geometry of the active gas jet are determined by the electrical, thermal and gas-dynamic conditions necessary for the formation and ignition of the electric discharge zone for gas activation. However, these conditions for gas activation in an electric discharge zone do not always prove to be the optimal conditions for surface treatment by means of the active gas jet.

For example, use of an electric discharge at atmospheric pressure and of the resulting temperatures higher than 5000 K for surface treatment is very problematic because the majority of materials to be processed do not withstand such temperatures. Another problem is posed for the electric discharge zone by high process gas velocities, e.g., supersonic velocity, because these velocities can be maintained under highly dynamic conditions only with the greatest difficulty. However, the above-mentioned uses of the active gas jet require higher gas throughput in order to reduce the time within which the active gas jet reaches the surface to be treated proceeding from the discharge zone, since the loss of activity of the gas jet is effectively reduced by reducing the recombination processes.

OBJECT AND SUMMARY OF THE INVENTION

It is the primary object of the invention to find a novel possibility for generating a chemically active jet (active gas jet) by means of a plasma generated by electric discharge in a utilized process gas in which a high chemical activity develops at increased process gas velocity of the active gas jet on the surface to be treated and is electrically neutral already at the output of the arrangement, so that it does not pose a threat to the operating personnel, the environment and the treated surface.

According to the invention, this object is met in an arrangement for generating a chemically active jet (active gas jet) by means of a plasma generated by electric discharge in a utilized process gas with an essentially cylindrical discharge chamber through which process gas flows and in which plasma is generated due to an electric gas discharge for activating the process gas, with a gas inlet for continuously feeding the process gas into the discharge chamber, and with an outlet opening for directing the active gas jet to a surface to be treated, characterized in that the discharge chamber has a conically narrowing end for increasing the velocity of the active gas jet, a limiting channel for preventing propagation of the discharge zone into the free space for the surface to be treated is arranged following the narrowed end of the discharge chamber, wherein the limiting channel is essentially cylindrical and is grounded and its length is greater than its cross section by a factor of 5–10.

An arc discharge is advantageously provided for activating the process gas. The discharge chamber has a center electrode and a hollow electrode which covers the inner wall of the discharge chamber in a planar and symmetrical manner at least in the area of the conically narrowing end. The limiting channel preferably directly adjoins the hollow electrode. The center electrode is advisably rod-shaped and is arranged in the gas inlet area along the axis of symmetry of the discharge chamber.

In order to enhance the performance of the active gas jet through enlarged electrode surfaces, the center electrode can advantageously be shaped like a cylinder cap which has an outer cylindrical surface of low height and a cover surface and whose opening is oriented coaxial to the axis of the discharge chamber and arranged above the gas inlet of the discharge chamber.

To improve the stability of the parameters of the active gas jet, it is advantageous for activation of the process gas to arrange the discharge chamber in an induction field generated by high frequency (radio frequency). This can advisably be carried out in that the discharge chamber (1) is provided with two electrodes which are arranged along the wall of the discharge chamber in the direction of flow of the process gas and which are operated at radio frequency. The high-frequency excitation for activating the process gas can also advantageously be achieved by generating an induction field in that the discharge chamber is arranged in a coil operated at radio frequency. A further possibility for activating the process gas without contaminating the active gas by electrode material is given in that the discharge chamber is arranged in a waveguide connected to a microwave source.

For purposes of shaping, selection of the type of flow (laminar or turbulent flow) and adjustment of the active gas jet with desired parameters, particularly velocity, temperature, geometric shape and type of flow, a jet-shaping device is advisably arranged following the limiting channel. In this connection, it can be advantageous that branched nozzles are connected to the output of the limiting channel for treating individual partial surfaces or depressions in the surface to be treated. The jet-shaping device is advisably adapted to the shape of the surface to be treated by means of guiding plates, and the distance between the surface and the jet-shaping device is kept within a defined small range, so that the effectively treated surface covers a larger area.

Jet-shaping devices which integrate two or more of the inventive arrangements for generating the active gas jet in a treatment channel are provided for special applications of an active gas jet. In the treatment channel, with continuous throughput of material, a plurality of workpiece surfaces to be treated can be treated simultaneously or surfaces of continuous sections with a desired cross section can be treated on all sides.

When using an active gas jet with special additives (especially for coating of surfaces), a feed pipe is preferably arranged axially in the discharge chamber for introducing additives. The feed pipe ends shortly before the output of the discharge chamber, wherein additives are prevented from influencing the discharge characteristic and the additives or their reaction products are prevented from contaminating the discharge chamber (1).

It has proven advantageous for achieving a defined gas flow when the limiting channel comprises a plurality of individual channels in order to reduce the gas-dynamic resistance and the dwell time of the active gas in the limiting channel. The individual channels are arranged so as to be uniformly distributed around a central channel. In this connection, additives are supplied in a particularly advantageous manner when the limiting channel with a plurality of individual channels has a central inlet channel for the additives, wherein the inlet channel is arranged axially in the center of a ring of individual channels through which active gas flows, since a premature reaction or a destruction of the additives and contamination of the discharge chamber by additives can be prevented.

In all of the feed variants mentioned above, the additives can advantageously be introduced into the area of the limiting channels as gases, liquids in the form of aerosols or solids in the form of fine particles.

In a particularly advisable variant arrangement of the invention, the hollow electrode, the limiting channel and the jet-shaping device are manufactured as an individual rotating body with very good electrical conductivity, the center electrode is introduced into the discharge chamber formed by the hollow electrode so as to be enclosed coaxially by an insulating pipe, and the gas inlet into the discharge chamber is initially supplied to a cylindrical distribution chamber. Tangential flow channels from the distribution chamber to the discharge chamber are provided for the process gas, so that arc discharges between the center electrode and hollow electrode are fixated at the end of the center electrode protruding from the insulating pipe due to the resulting spiral gas flow from the distribution chamber into the discharge chamber. This prevents erosion of the insulating pipe to a great extent. In addition, tangential flow channels can advantageously be guided into a cylindrical annular chamber between the rod-shaped center electrode and inner surface of the insulating pipe, so that the center electrode is cooled directly by a proportion of the process gas and outlet points of arc discharges are substantially confined to non-cylindrical surfaces of the center electrode. Therefore, the insulating pipe is protected against the erosive effect of the discharge arc even more effectively.

The center electrode advisably protrudes over the insulating pipe by a length of up to twice the diameter of the center electrode. When the additional process gas feed inside the insulating pipe is used, the end of the center electrode can be shortened and, in extreme cases, terminates with the end of the insulating pipe.

The limiting channel is preferably slightly conically narrowed in the direction of gas flow and has an average ratio of channel diameter to channel length of 1:8. A jet-shaping device with an outlet that widens in a bell-shaped manner advantageously adjoins the limiting channel, so that the working width of the active gas jet is increased.

The fundamental idea of the invention is based on the fact that in the known prior art arrangements with a plasma-induced active gas jet either the activity of the gas jet is insufficient or the active gas jet still has a dangerously high electric potential as it exits into the processing space resulting in risk to operating personnel. These problems, which influence one another, are overcome according to the invention in that the process gas is guided through three zones in sequence. First, the process gas (in the discharge space) is activated and accelerated, then the propagation of the discharge zone out of the discharge space into the active gas jet caused by velocity is contained (limited) in a narrow, grounded limiting channel and, finally, a chemically active, electrically neutral active gas jet is shaped by jet-shaping devices corresponding to the desired application (cleaning, coating, activation, etc.). The arrangement according to the invention can be combined with all known methods of plasma-induced activation of process gases in which a corona discharge zone, a glow discharge zone or an arc discharge zone (using DC, AC or pulsed current) or a high-frequency discharge zone generated in the electromagnetic alternating field (with excitation frequencies up to the microwave range) is formed.

The efficiency of the limiting channel depends substantially on its having a smaller diameter in relation to the discharge chamber. Therefore, the discharge chamber is conically narrowed in the flow direction of the process gas, so that the velocity of the active gas jet increases substantially when there is a large ratio of the cross section of the discharge chamber to the cross section of the limiting channel, and the time required for the chemically active particles of the active gas jet to travel the distance from the discharge chamber to the point of application is sharply reduced. Due to the reduced time, there are fewer recombinations of active particles (reduced activity loss of the active gas jet) and this leads to increased effectiveness of the active gas jet on the surface to be treated. At a very high gas throughput through the discharge zone, discharge brushes arch out of the discharge zone in the exiting active gas jet. With high current at the same time, the electric conductivity, and the electrical resistance of the plasma arc related to it, leads to a considerable potential relative to the grounded electrode, also at a close distance to the plasma arc of the grounded electrode. In order to prevent the discharge brushes with dangerous electric potential from exiting into the free space, the active gas jet at the output of the discharge zone is guided through a narrow, grounded channel. The limiting channel is dimensioned in such a way that a discharge arc entering it has a potential which is still too low at the entrance into the limiting channel for breakdown to the channel wall. As the path length in the limiting channel increases, the voltage in the discharge arc rises until breakdown to the channel wall. Therefore, the limiting channel must have a minimum length corresponding to the rest of the conditions of plasma generation which ensures that the above-mentioned arching of the discharge zone in the free space can not occur. This takes place at a ratio of cross section to channel length of 1:5 to 1:10.

The arrangement according to the invention allows an electrically neutral, chemically active jet to be generated, wherein a high chemical activity develops on the surface to be treated at increased process gas velocity of the active gas jet and the active gas jet is electrically neutral already at the output of the arrangement, so that it does not pose a threat to operating personnel, the environment or the treated surface.

In the following, the invention will be described more fully with reference to embodiment examples.

DESCRIPTION OF THE PREFERRED EMBODIMENTS

Figure 1:
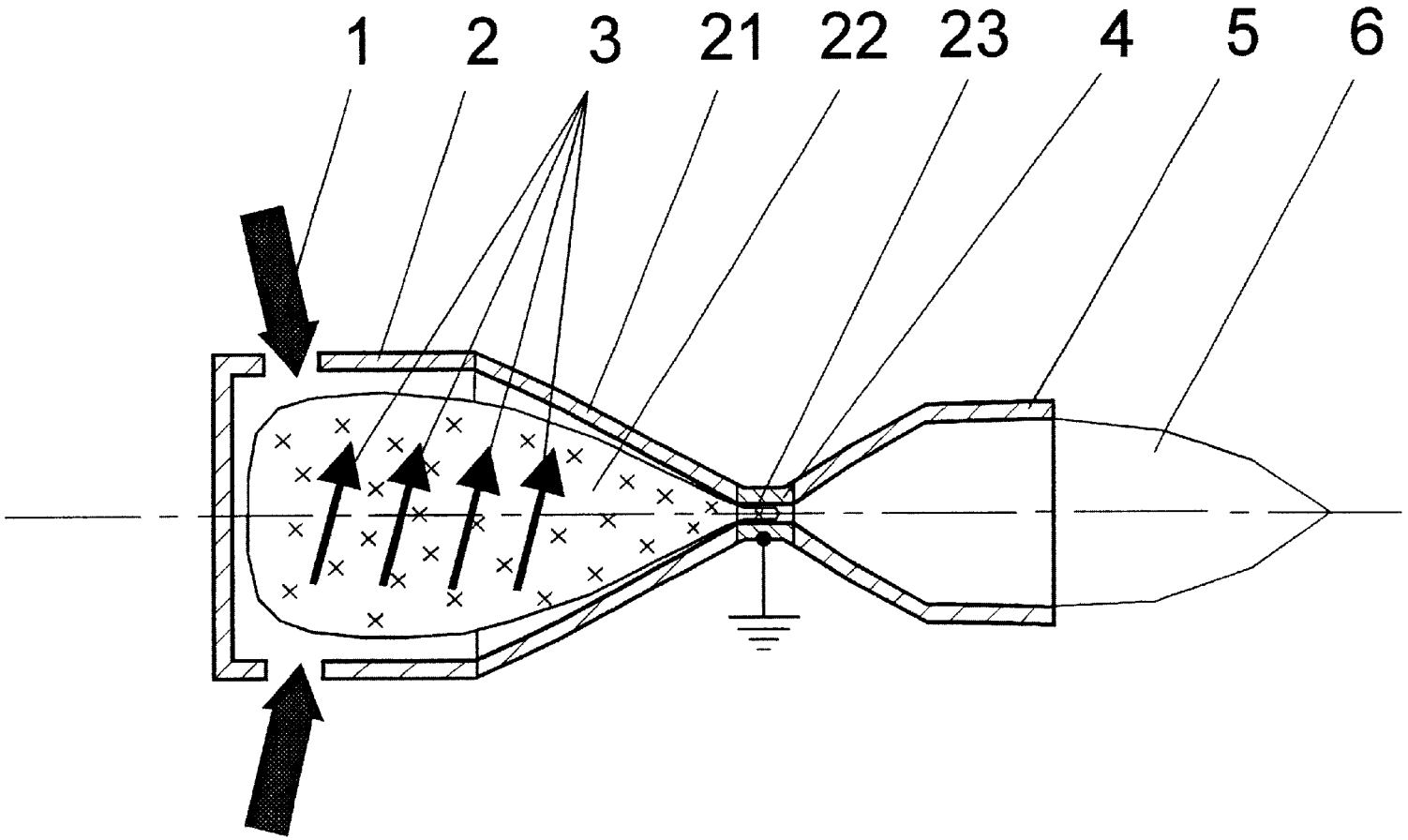
FIG. 1 shows a schematic view of the arrangement according to the invention with electric discharge which is triggered by a selected electromagnetic field.

The arrangement for generating an active gas jet according to FIG. 1 basically comprises a discharge chamber 2 through which a process gas 1 flows and in which activation of the process gas 1 takes place in the form of an electric discharge generated by a strong field 3, a substantially cylindrical limiting channel 4 and a jet-shaping device 5 for the active gas jet 6 provided for material processing in the free space.

The discharge chamber 2 has a conically narrowed end 21 (i.e., a shape that is narrowed in the manner of a nozzle) in the direction of flow of the process gas 1 which serves to increase the flow velocity of the process gas 1 when it is activated in the discharge chamber 2. When the gas velocity is increased, the time required for reaching a surface 7 (shown only in FIGS. 7 to 9) to be treated is reduced and the recombination of active gas particles before the treatment location is reached is decreased. However, with increased flow velocity there is an increased risk that a discharge zone 2 which forms in the discharge chamber 2 due to the effect of the field 3 will progress toward the outside via the conically narrowed end 21 of the discharge chamber 2. In order to prevent so-called discharge brushes with a dangerously high electric potential from exiting the discharge chamber 1 into the free space as arching 24 of the discharge zone 22 due to the high gas velocity, the active gas jet 6 at the output of the discharge chamber 1 which is accelerated by the narrowed end 21 is guided through a narrow, grounded limiting channel 4. This effectively prevents limiting of the propagation of the discharge zone 22 in the direction of the free outlet opening of the active gas jet 6.

The limiting channel 4 is dimensioned in such a way that the part of the discharge zone 22 entering it reaches a potential whose magnitude at the entrance to the limiting channel 4 is too small for a breakdown to the channel wall, but which increases as the path length in the limiting channel 4 increases until a breakdown to the grounded wall of the limiting channel 4 occurs.

Further, in accordance with the rest of the conditions of plasma generation required for the activation of the process gas 1, the limiting channel 4 must have a minimum length which ensures that the above-mentioned arching 24 of the discharge zone 22 in the free space can not occur. This is achieved in general with a ratio of the channel cross section to the channel length of 1:5 to 1:10.

However, the efficiency of the active gas jet 6 also depends substantially on the limiting channel 4 having an appreciably smaller diameter in relation to the main part of the discharge chamber 2 (before its conically narrowed end 21), so that the velocity of the active gas jet 6 increases substantially with a large ratio (1:5 to 1:8) of the cross section of the discharge chamber 2 to the cross section of the limiting channel 4, so that the time needed for the chemically active particles of the active gas jet 6 to travel the distance from the discharge chamber 2 to the point of application is sharply reduced. Due to the reduced time, fewer recombinations of active particles take place (reduced activity loss of the active gas jet 6) and this results in an increased effectiveness of the active gas jet 6 on the surface 7 to be treated (not shown in FIG. 1). On the other hand, due to the small diameter of the limiting channel 4, the aerodynamic resistance at the narrowed end 21 of the discharge chamber 2 increases and the effectiveness within the discharge zone 22 is impaired. The reason for this is that the temperature of the plasma increases with rising pressure. Therefore, the limiting channel 4 is substantially cylindrical and has a cross section of 1:5 to 1:8 adapted to the diameter of the discharge chamber 2.

Process gas 1 is introduced into the discharge chamber 2. The supplied process gas 1 is activated by interaction with the field 3 in the electric discharge zone 22, accelerated and, for the most part, discharged in the conically narrowed part 21 of the discharge chamber 2 and is introduced into the limiting channel 4 which prevents the propagation of the discharge zone 22 outward into the free treatment space. After the limiting channel 4, the active gas jet 6 flows through a jet-shaping device 5 in which it is shaped with respect to velocity, temperature, geometric shape and type of flow (laminar or turbulent flow) depending on the purpose of application. The discharge zone 22 can be formed in any desired manner (depending upon the type of field generation that is used) by DC current, AC current or pulsed current, electromagnetic induction, microwaves or other types of excitation which trigger an electric gas discharge in the utilized process gas 1.

Figure 2:
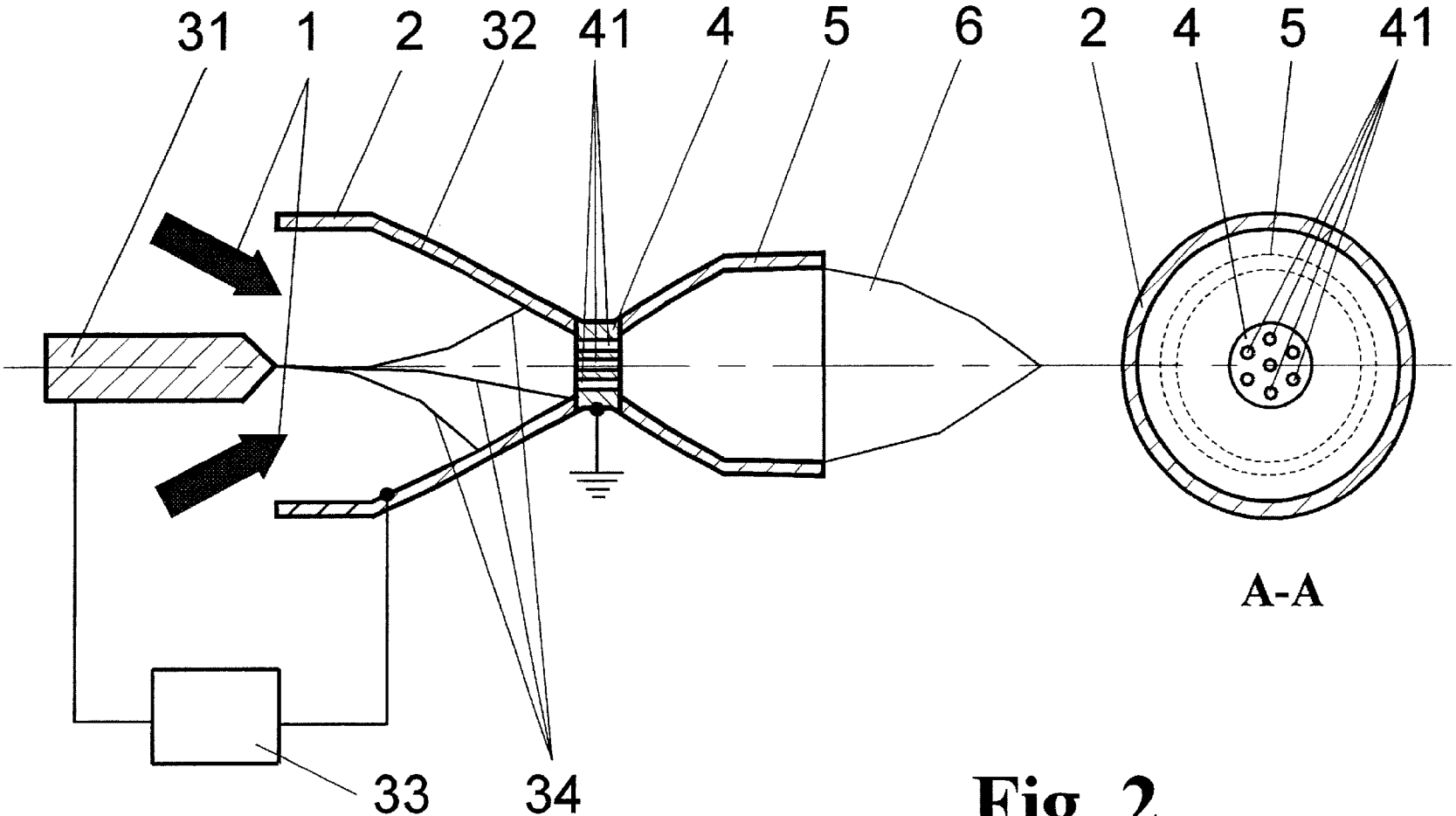
FIG. 2 shows a construction of the invention with electric arc discharge between a rod-shaped center electrode and a hollow electrode at the wall of the discharge chamber and with a limiting channel comprising a plurality of individual channels.

FIG. 2 shows a variant of the invention in which activation of the process gas 1 is carried out by an arc discharge 34 between two electrodes in the discharge chamber 2. One of the electrodes is a rod-shaped center electrode 31; the other is located at the inner wall of the discharge chamber 2 and forms a so-called hollow electrode 32. The hollow electrode 32 is arranged at least at the conically narrowed end 21 of the discharge chamber 2. However, it can also form the wall of the discharge chamber 2 itself (as is shown, e.g., in FIG. 13).

The process gas 1 is introduced tangentially into the discharge chamber 2 in which an electric arc discharge 34 takes place between the center electrode 31 and the hollow electrode 32 along the inner wall of the discharge chamber 2 by means of a generator 33.

The process gas 1 is activated by interacting with the electric arc discharge 34, is accelerated in the conically narrowed part 21 of the discharge chamber 1 and is discharged for the most part on the way to the limiting channel 4. In the subsequent limiting channel 4 which receives an arching 23 of the discharge zone 22 that may occur at high gas velocities, the electric potential of the discharge zone 22 is prevented from spreading outward into the free space of the surface 7 to be treated. At a very high gas throughput through the discharge chamber 2, discharge brushes are blown out in the active gas jet of the limiting channel 4, i.e., an arching 23 of the discharge zone 22 is formed. With simultaneous high current, the electric conductivity and the electric resistance of the plasma arc related thereto (electric discharge arc in the process gas 1) result in a considerable potential relative to the grounded hollow electrode 32, also at a close distance to the plasma arc. Therefore, a considerable electric potential also occurs outside the discharge chamber 2 when operating with high process gas velocity. This potential can amount to several hundred volts at the circular end of the hollow electrode 32 under some circumstances. This phenomenon poses a danger to the operating personnel in the event that the treatment space adjoins this location. Moreover, in case of the emergence of discharge brushes, electrical defects could result at sensitive surfaces of the objects to be treated, e.g., semiconductors or semiconductor structures. In order to prevent arching 23 (discharge brushes) with dangerous electric potential from exiting the discharge zone 22 into the free space due to a high active gas velocity, the active gas jet 6 at the output of the discharge chamber 2 is conducted through the narrow, grounded limiting channel 4 in which another discharge of the active gas jet 6 is carried out with a certain aerodynamic impact. The limiting channel 4 is dimensioned in such a way that the arching 23 of the discharge zone 22 entering it has a potential whose magnitude at the entrance into the limiting channel 4 is still too small for a breakdown to the channel wall. As the path length in the limiting channel 4 increases, the voltage in the discharge arc increases until there is a breakdown to the channel wall. Therefore, the limiting channel 4, in accordance with the rest of the conditions of plasma generation, must have a minimum length which ensures that the arching 23 of the discharge zone 22 mentioned above can not traverse the limiting channel 4 and which is indicated by a ratio of the cross section to the channel length of 1:5 to 1:10. The active gas jet 6 has a temperature which is comparable to the temperature at the output of the discharge chamber 2, but the gas throughput and the dimensions and construction of the limiting channel 4 contribute as well in determining its gas-dynamic characteristics (velocity and flow conditions).

After the limiting channel 4, the active gas jet 6 flows through the jet-shaping device 5 in which it is shaped with respect to velocity, temperature, geometric shape and type of flow (laminar or turbulent flow) depending upon the purpose for which it is used. Different constructions of jet-shaping devices 5 can be used for this purpose, e.g., nozzles constructed in such a way that adiabatic expansion of the active gas jet occurs in order to reduce temperature, or flattened jet-shaping devices 5 such as are described more fully in the following in order to form a flat, broad active gas jet 6.

The electric discharge zone 22 can be formed for the described arrangement in any desired manner (depending upon the type of voltage generator 33 that is used) by DC current, AC current or pulsed current.

Unfortunately, the active gas jet 6 generated in the discharge chamber 2 also loses its activity in part when flowing through the limiting channel 4 due to recombination of the active particles and because of the active gas jet 6 interacting with the channel wall. In order to reduce the effect of the processes mentioned above, a simultaneous reduction in the cross section of the limiting channel 4 is required when the channel length is shortened. However, this would increase the aerodynamic resistance of the limiting channel 4 and impair effectiveness within the discharge chamber 2. The reason for this is that the temperature of the plasma increases with rising pressure. A greater thermal loading of the center electrode 31 and hollow electrode 32 is caused at the same time which leads to increased electrode wear. This can be reduced in that the limiting channel 4 comprises two or more grounded individual channels 41 which are arranged parallel to one another in electrically conducting material and give a more effective flow cross section. FIG. 2 shows a construction in which additional individual channels 41 are arranged so as to be uniformly distributed around a center individual channel 41.

Figure 3:
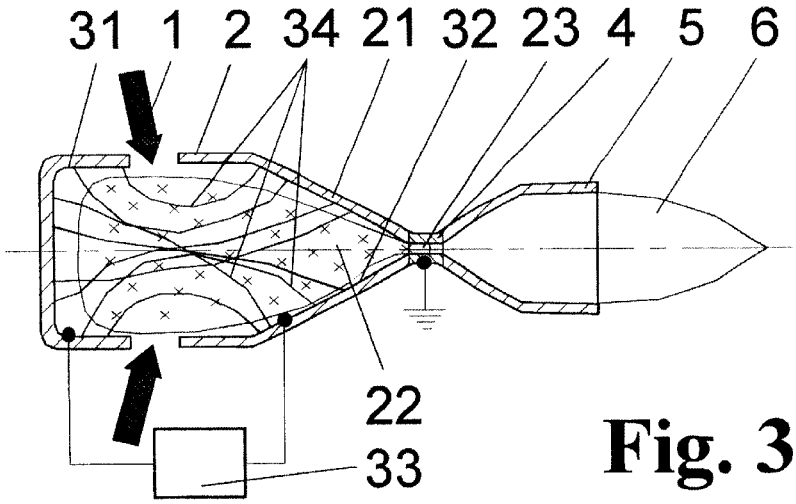
FIG. 3 shows an arrangement of the invention with arc discharge by a center electrode in the form of a cylinder cap.

In FIG. 3, an active gas jet 6 is generated, but—in contrast to the example described above—the center electrode 31 has the form of an electrically conducting cylinder cap instead of being rod-shaped. This center electrode 31 is arranged coaxially with its opening in the direction of the discharge chamber 2. The process gas 1 is introduced tangentially into a gap between the cylindrical center electrode 31 and the discharge chamber 2. When using the center electrode 31 shaped in this manner, the supporting surface of the arc discharge 34 on the center electrode 31 is enlarged, i.e., the roots of the arc discharges 34 move on a larger surface with an intensively whirled flow of the process gas 1. In this way, overheating of the center electrode 31 is prevented and the life and maximum discharge flow are increased.

Figure 4:
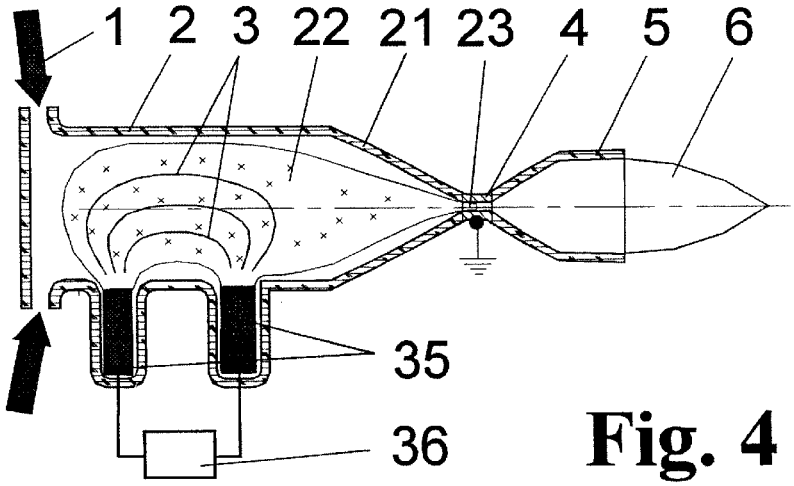
FIG. 4 shows an arrangement with a high-frequency field generated by inner electrodes.

FIG. 4 shows a variant in which the process gas 1 is activated between two electrodes 35 arranged in the discharge chamber 2 successively in the direction of flow. The discharge zone 22 is generated by a high-frequency discharge in an alternating field 3 by means of a high-frequency generator 36, wherein the discharge chamber 2 comprises an electrically insulating material (e.g., quartz).

It is sufficiently well known that the electric discharge occurring when using cold electrodes 35 at determined pressures, e.g., at atmospheric pressure, is unstable if additional steps are not taken because high electron densities and energy gradients in front of the electrodes 35 generate a space charge layer and destabilize the discharge. In high-frequency discharges, this stabilization is achieved through simple steps (as is described, for example, in J. Reece Roth, "Industrial Plasma Engineering, Vol. 1: Principles, Inst. of Physics Publishing, Bristol and Philadelphia, 1995: 382–385, 404–407, 464f.). Due to this fact that a stable discharge can be obtained in simple manner, a H-F discharge is particularly advantageous for activating the process gas 1.

Figure 5:
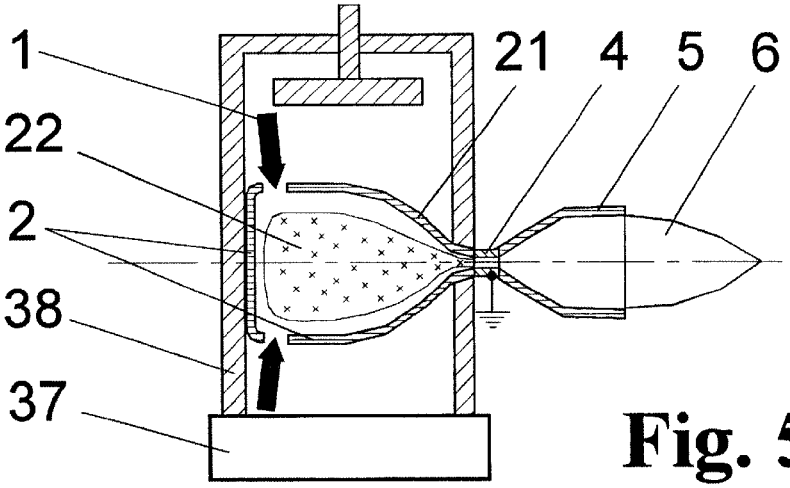
FIG. 5 shows an embodiment form in which the gas discharge is generated by microwaves.

However, all electrodes such as those described in the preceding variants for generating the electric discharge zone 22 are exposed to a greater or lesser extent to a process of erosion, i.e., wear. This leads to contamination of the discharge chamber 2 and of the process gas 1 by electrode material. In order to generate an active gas jet 6 which is free from contamination by electrode material, the discharge zone 22 is generated without electrodes according to FIG. 5. For this purpose, the discharge chamber 2 which, in this example, comprises material which is electrically insulating but transparent to microwaves, is introduced into the field 3 of a microwave generator 37. In a typical microwave conductor 38 connected to the microwave generator 37, a location with a relatively homogeneous and high field strength is used. All the rest of the processes producing the active gas jet 6 from the discharge zone 22 take place corresponding to the preceding examples.

Figure 6:
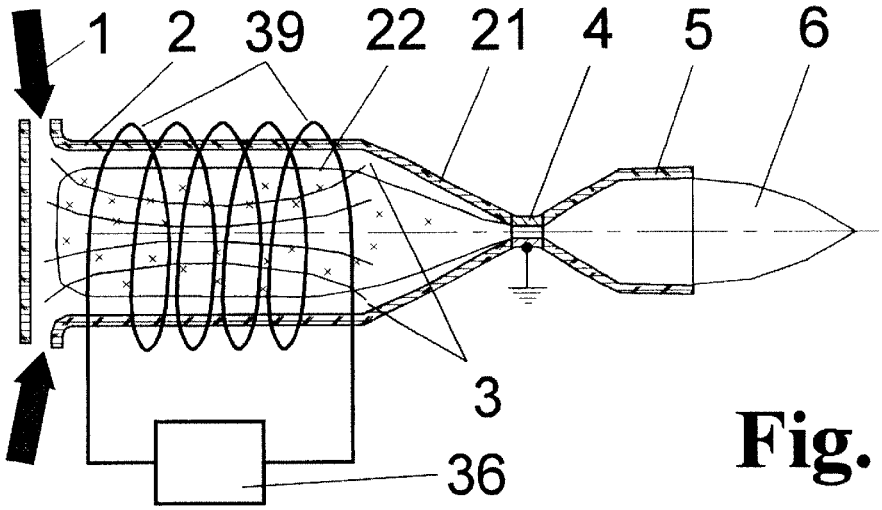
FIG. 6 shows an arrangement with a high-frequency field generated by induction.

FIG. 6 shows an activation of the process gas 1 which is also carried out without electrodes. In this case, a high-frequency generator 36 is used to induce a high-frequency alternating field 3 in the discharge chamber 2 with a coil 39. The discharge chamber 2 is arranged inside the windings of the coil 39 and forms the desired discharge zone 22 internally. The choice of material for the discharge chamber 2 is relatively open, but this material must not be ferromagnetic. As was already described in the previous examples, the process gas 1 is accelerated in the conically narrowed end 21 of the discharge chamber 2 and is its dangerous potential is eliminated in the grounded limiting channel 4, so that an electrically neutral active gas jet 6 is available at the output of the jet-shaping device 5.

Figure 7:
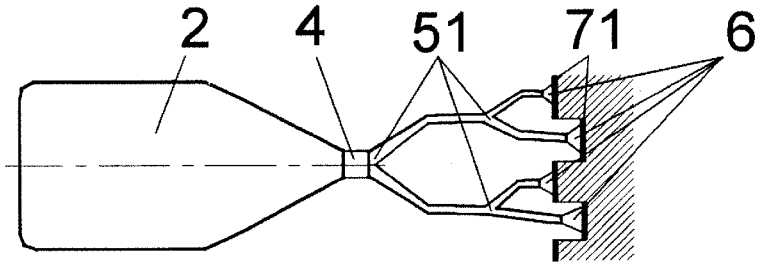
FIG. 7 is a schematic view of the invention for dividing the active gas jet for simultaneous treatment of individual partial surfaces on surfaces with complicated relief.

For exacting surface treatments, it is often necessary to treat individual parts of surfaces 7 or depressions in workpieces equivalently. For this purpose, the active gas jet 6 which is originally unitary is divided into a plurality of jets for the treatment of individual surface portions 71 and depressions. FIG. 7 schematically shows a discharge chamber 2 in which the electric discharge can be generated in any desired manner. The generated active gas is conducted out of the discharge chamber 2 through the limiting channel 4 into a jet-shaping device 5 having branched nozzles 51. The branched nozzles 51 are directed to different partial surfaces 71 which have different heights in the surface 7 to be treated and each of which conducts a proportion of the active gas jet 6 to the partial surfaces 71.

Figure 8:
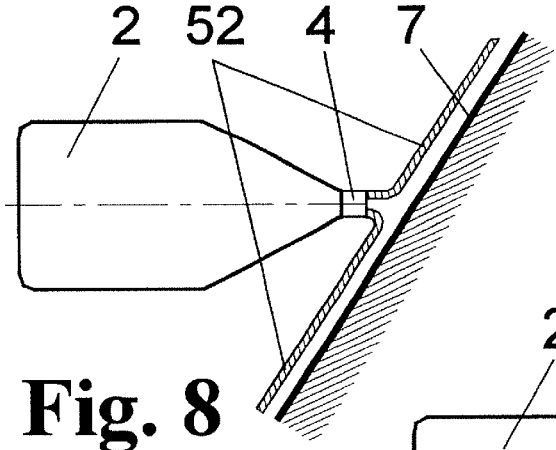
FIG. 8 shows a schematic view of the arrangement according to the invention, wherein the jet-shaping device is adapted to a plane surface.
Figure 9:
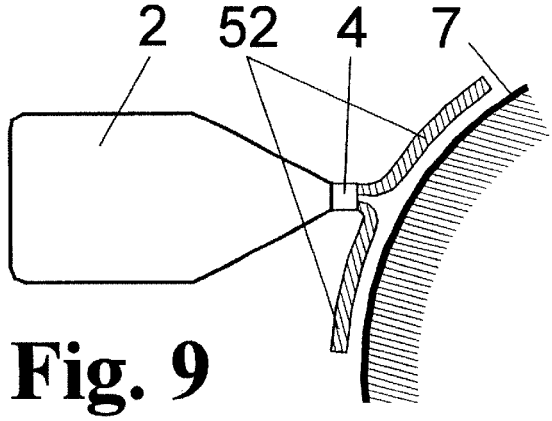
FIG. 9 shows a schematic view similar to FIG. 8, wherein the jet-shaping device is adapted to a spherical surface.

In the plasma jet generators known for surface treatment, e.g., according to DE 195 46 930 C1, DE 195 32 412 A1, the gas jet widens after leaving the generator and before reaching the surface to be treated. However, if it widens excessively, the gas jet loses too much activity on the way to the surface 7 due to recombination and interactions with the gas particles in the surrounding atmosphere. Therefore, some additional steps are suggested for the invention which keep activity losses low from the time that the active gas jet 6 is generated until it reaches the surface 7 to be treated, also when a large surface 7 is to be treated simultaneously. In this connection, FIGS. 8 and 9 show two possibilities for regularly shaped surfaces 7. In FIG. 8, substantially flat guiding plates 52 which are angled and directly adjoin the limiting channel 4 are provided as a jet-shaping device 5. These guiding plates 52 must be guided uniformly at a slight distance above the flat surface 7. By means of this step, the high gas velocity which is generated already in the discharge chamber 2 that is narrowed at its the end and which passes through the limiting channel 4 is also continued in the jet-shaping device 5 in the form of a jet which is guided parallel to the surface 7 by a kind of barrier layer conduction. Accordingly, chemically active particles of the active gas jet 6 which changes into a virtually laminar flow reach a larger area on the surface 7 to be treated in a very short time even before they can recombine. FIG. 9 shows the same type of operation for a spherical surface 7. In this case, the guiding plate 52 must have a concentric curvature corresponding to the curvature of the surface in order to achieve the same effect of the laminar flow layer.

Figure 10:
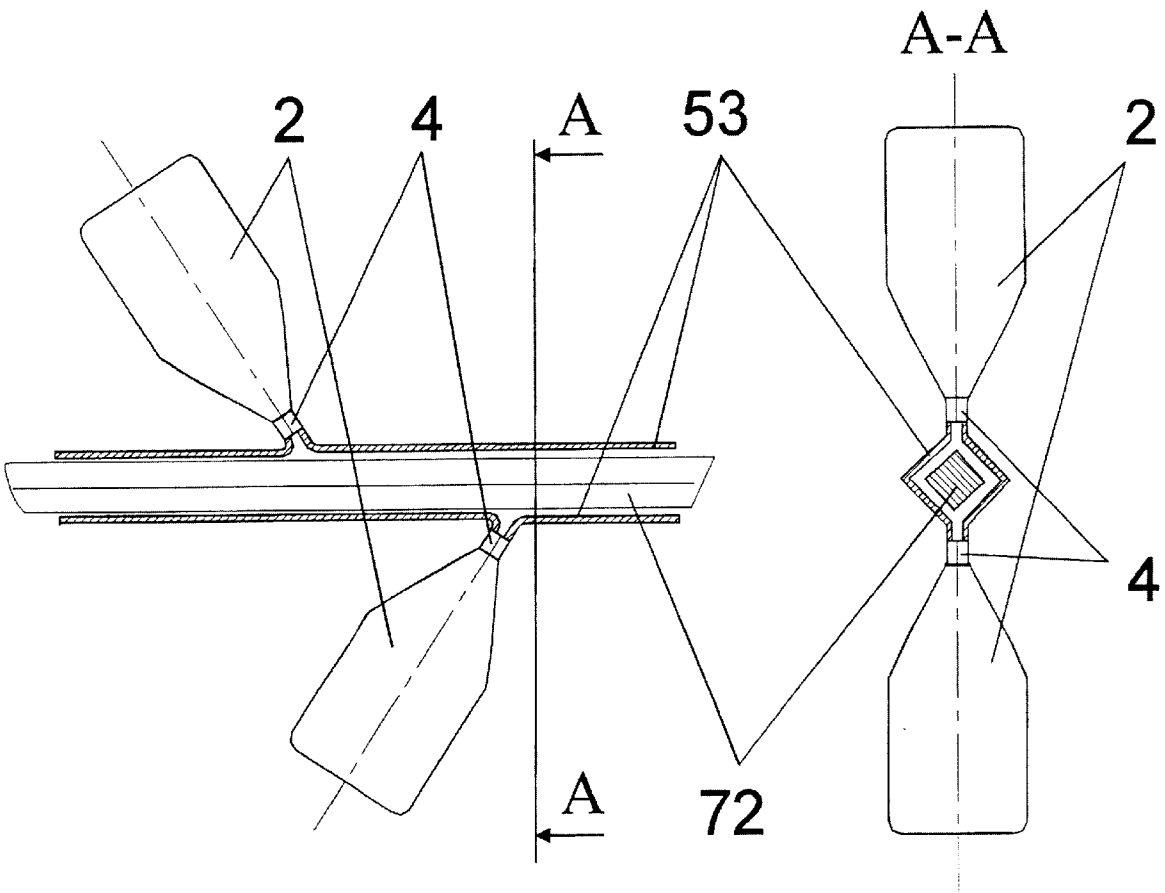
FIG. 10 shows a special construction in which a plurality of arrangements according to the invention are integrated with their jet-shaping devices in a treatment channel with continuous material flow.

Another special construction of the jet-shaping device is shown in FIG. 10. This example has to do with the effective treatment of a continuous material flow in which either a continuous section 72 or a material flow of identical workpieces is to be treated simultaneously on a plurality of surfaces 7 by an active gas jet 6. In FIG. 10, a continuous section 72 is guided through a closed treatment channel 53, and an arrangement according to the invention is arranged on at least two opposite sides of this treatment channel 53 diagonal to the movement direction of the continuous section 72.

Figure 11:
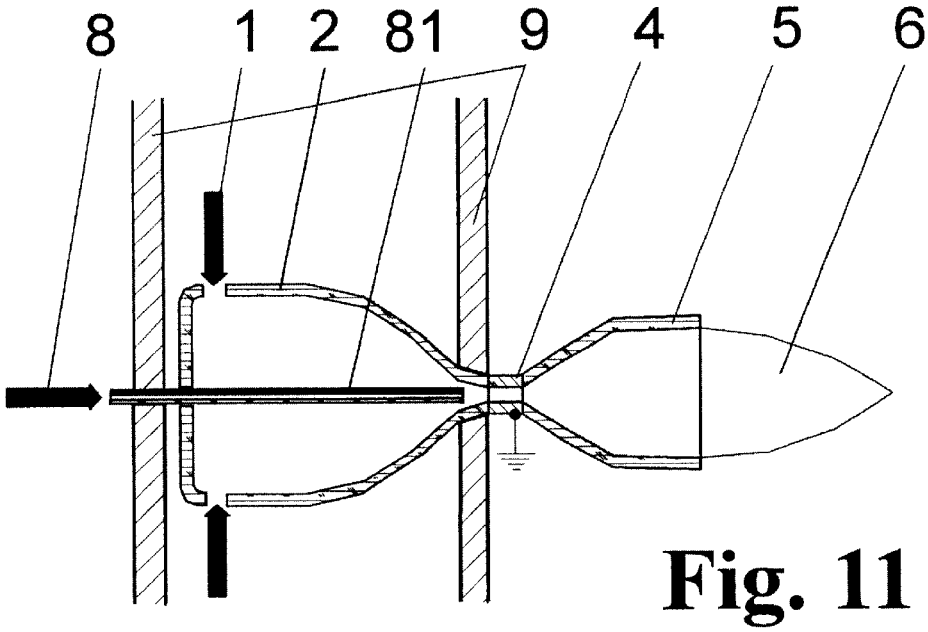
FIG. 11 shows an embodiment form for supplying additives before the start of the limiting channel.
Figure 12:
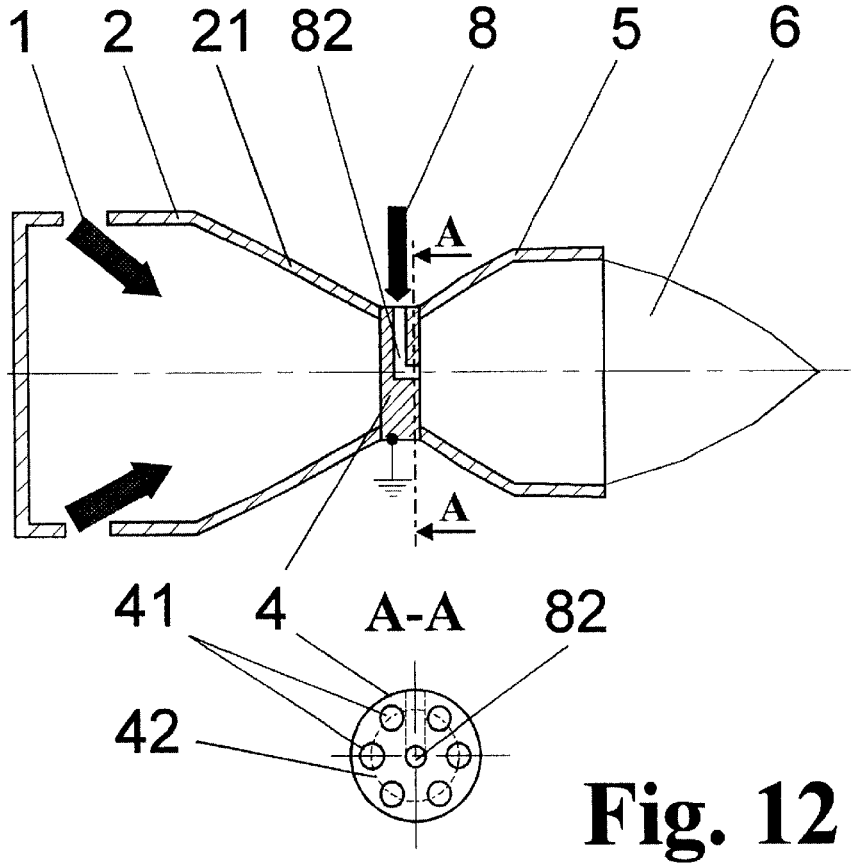
FIG. 12 shows a variant for supplying additives at the end of the limiting channel.

All of the arrangements described so far have dealt only with the use of a process gas or process gas mixture which is introduced directly into the discharge chamber 1 in a corresponding arrangement. If an additional material is to be added which is not to be activated in the discharge zone 22, there are two possible arrangements which can be realized either by adding directly before the limiting channel 4 according to FIG. 11 or by introducing directly into the neutral active gas jet 6 after the limiting channel 4 in the jet-shaping device 5 according to FIG. 12.

In the first case (FIG. 11), the additive 8 is supplied via a high-temperature-resistant feed pipe 81 which ends a few millimeters before the end of the limiting channel 4 facing the discharge zone 22 and is made of ceramic, quartz or a comparably temperature-resistant material. The mass flow of this additive 8 may make up only a fraction of the mass flow of the process gas 1 in the discharge chamber 2 so that there is as little interference as possible in the discharge chamber 2 due to this additive 8. In this embodiment form, the discharge chamber 2 is incorporated in a housing 9 because it is assumed in this case that the process gas 1 is activated without electrodes. In the simplest case, the housing 9 represents a waveguide 38 with connected microwave source 37 according to FIG. 5, but can also receive a coil 39 according to FIG. 7 as well as an associated cooling arrangement.

In the second case (FIG. 12), the activated process gas 1 is guided through a limiting channel 4 with a plurality of parallel individual channels 41 which are arranged in a ring 42. Instead of a central individual channel 41, a feed channel 82 which is supplied from the outside is located in the center of the limiting channel 4 which is constructed as a thick perforated plate. The additive 8 is introduced into the center of an active gas jet 6, which is shaped approximately like a gas ring, via this feed channel 82 which is guided inside the metal perforated plate of the limiting channel 4 from the outside in the center of the ring 42 of individual channels 41. Since the active gas jet 6 flows out at a very high velocity due to the small cross sections of the individual channels 41, the mass flow of the additive 8 via the feed channel 8 can be varied over a large area and can be adjusted very precisely.

Figure 13:
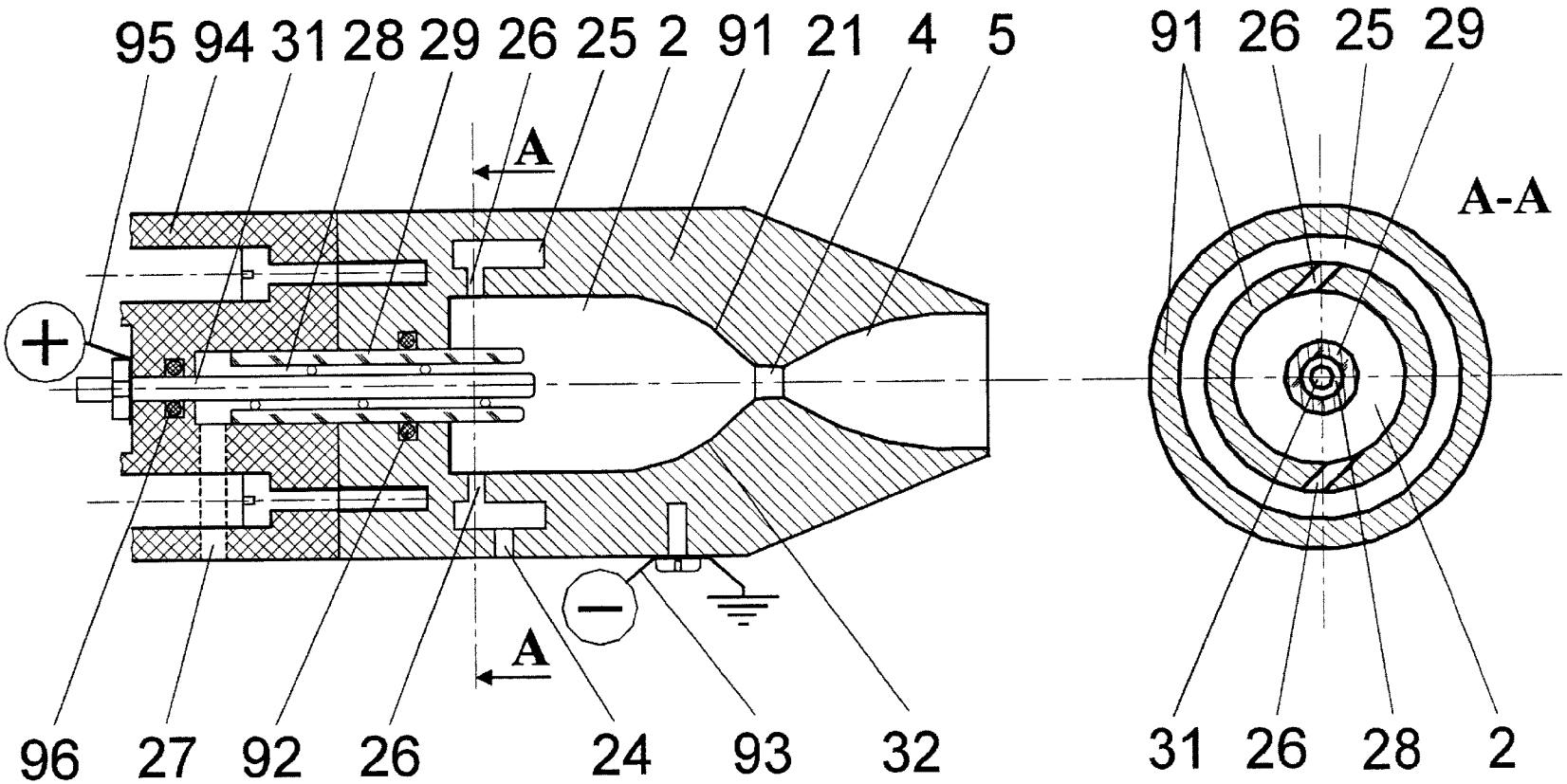
FIG. 13 shows a construction of the arrangement with a special arrangement of the flow channels for the supplied process gas with activation by means of arc discharge.

FIG. 13 shows the longitudinal section and cross section of the arrangement for generating an electrically neutral active gas jet 6 in a handheld housing 9. The arrangement comprises a discharge chamber 2, limiting channel 4 and jet-shaping device 5 which are formed as a base body 91 unit in the form of a handheld piece (pen) of copper or other very good electrical conductor, a rod-shaped center electrode 31 which is arranged coaxial to the wall of the discharge chamber 2 by means of an insulating pipe 29 made of quartz. The discharge chamber 2 forms the hollow electrode 32 at the same time. The insulating pipe 29 is sealed in a gastight manner with respect to the discharge chamber 2 by means of an elastic sealing ring 92 in the base body 91. The end of the center electrode 31 protrudes from the insulating pipe 29 into the discharge chamber 2 by a length of up to twice the diameter of the center electrode 31. The insulating pipe 29 itself projects into the discharge chamber 2 by a length equal to its own outer diameter and accordingly, outside its outer surface, forms a portion of the discharge chamber 2 in the form of a hollow cylinder. In this hollow cylinder near the rear end wall of the discharge chamber 2, the process gas 1 is introduced symmetrically into the discharge chamber 2.

The conically narrowed end 21 of the discharge chamber 2 passes smoothly into the narrow limiting channel 4. The diameter of the limiting channel 4 is in a ratio of 1:8 to its length and is shown only schematically (not true to scale) in FIG. 13. The jet-shaping device 5 adjoins the limiting channel 4. The discharge chamber 2, the limiting channel 4 and the jet-shaping device 5 are manufactured as a unit from copper and have a common grounded contact 93. The grounded contact 93 is connected at the same time to the negative pole of the voltage generator 33 (not shown in FIG. 13). The positive pole of the voltage generator 33 is connected to the center electrode 31.

The process gas 1 is supplied via the gas inlet 24 initially in a cylindrical distribution chamber 25 from which a spiral gas flow is generated in the hollow cylindrical portion of the discharge chamber 2 via uniformly distributed tangential flow channels 26. As a result of this step, the roots of the arc discharge 34 (not shown in FIG. 13) at the center electrode 31 are confined to the end face of the latter and the directly adjoining parts of the electrode surface, so that the insulating pipe 29 has less thermal loading and reduced erosion.

An insulating connection body 94 which carries the fastening and the connection of the center electrode 31 is fastened (e.g., screwed) to the rear end of the base body 91 or, more exactly, to the rear end face of the discharge chamber 2. The connection body 94 has an additional gas inlet 27 which is connected to the discharge chamber 2 via a narrow annular chamber 28 along the center electrode 31. A portion of the process gas 1 is supplied through this small annular chamber 28 between the center electrode 31 and insulating pipe 29 for electrode cooling and direct injection into the discharge zone 22. The annular chamber 28 is sealed at the back in the connection body 94 by an elastic ring 96 relative to the center electrode 31 which is guided through toward the rear to the connection terminal 95. Tangential flow channels 26 (for annular chamber 28, not shown) could also be provided in the annular chamber 28—as between the distributing chamber 25 and the hollow cylindrical part of the discharge chamber 2—for generating a spiral-shaped gas circulation. The arrangement according to FIG. 13 functions in the following way. A portion of the process gas 1 is fed through the additional gas inlet 27 and flows into the discharge chamber 2 through the annular chamber 28 between the center electrode 31 and the insulating pipe 29. At the same time, the other (larger) portion of the process gas 1 is fed through the gas inlet 24 via the distribution chamber 25, through the tangential openings 26 of the discharge chamber 2 in its hollow-cylindrical part which is formed by the hollow electrode 32 and the insulating pipe 29 projecting into the latter. This generates a spiral-shaped whirling flow in the discharge chamber 2. When process gas 1 is fed through the gas inlets 24 and 27 and DC voltage is applied at the same time between grounded contact 93 and connection terminal 95, an electric discharge occurs in the discharge chamber 2. The process gas 1 is activated due to the interaction in the discharge zone 22 (similar to FIG. 2, but not shown in FIG. 13), exits the discharge chamber 2 at high speed so as to be accelerated through its conically narrowed end 21 and flows through the adjoining limiting channel 4 and the jet-shaping device 5 into the (free) treatment space. The active gas jet 6 essentially loses its potential in the limiting channel 4; the potential at the end of the limiting channel 4 is virtually zero relative to ground. In the subsequent jet-shaping device 5, the active gas jet 6 is then given the width and shape desirable for the application (as described with reference to FIGS. 7 to 9, for example). A very effective chemically active gas jet 6 which is electrically neutral is accordingly available for any applications.

While the foregoing description and drawings represent the present invention, it will be obvious to those skilled in the art that various changes may be made therein without departing from the true spirit and scope of the present invention.

Reference Numbers

1 process gas
2 discharge chamber
21 conically narrowed end
22 discharge zone

23 arching of the discharge zone
24 tangential flow channels
25 distribution chamber
26, 27 gas inlet
28 annular chamber
29 insulating pipe
3 field
31 center electrode
32 hollow electrode
33 voltage generator
34 arc discharge
35 H-F electrode
36 H-F source
37 microwave source
38 microwave conductor
39 coil
4 limiting channel
41 individual channels
42 ring (of individual channels)
5 jet-shaping device
51 branched nozzles
52 guiding plate
53 treatment channel
6 active gas jet
61 partial jets
7 surface
71 partial surfaces
72 continuous section
8 additives
81 feed pipe
82 feed channel
9 housing
91 base body
92 elastic sealing ring
93 ground terminal
94 insulating connection body
95 connection terminal (of the center electrode)
96 elastic ring

What is claimed is:

1. An arrangement for generating a chemically active jet (active gas jet) by a plasma generated by electric discharge in a utilized process gas comprising:

an essentially cylindrical discharge chamber through which process gas flows and in which plasma is generated due to an electric gas discharge for activating the process gas;

a gas inlet for continuously feeding the process gas into the discharge chamber; and an outlet opening for directing the active gas jet to a surface to be treated;

said discharge chamber having a conically narrowed end for increasing the velocity of the gas being activated in a discharge zone inside the discharge chamber;

a limiting channel for preventing propagation of the discharge zone into the free space for the surface to be treated being arranged following the narrowed end of the discharge chamber;

said limiting channel being essentially cylindrical and not divergently shaped and being grounded and having its length being greater than its cross section by a factor of 5–10.

2. The arrangement according to claim 1, wherein an arc discharge is provided for activating the process gas, wherein the discharge chamber has a center electrode and a hollow electrode which covers the inner wall of the discharge chamber in a planar and symmetrical manner at least in the area of the conically narrowed end.

3. The arrangement according to claim 2, wherein the limiting channel directly adjoins the hollow electrode.

4. The arrangement according to claim 2, wherein the center electrode is rod-shaped and is arranged along the axis of symmetry of the discharge chamber.

5. The arrangement according to claim 2, wherein the center electrode is shaped like a cylinder cap which has an outer cylindrical surface of low height and a cover surface and whose opening is oriented coaxial to the axis of symmetry of the discharge chamber and arranged above the gas inlet of the discharge chamber.

6. The arrangement according to claim 1, wherein the discharge chamber is arranged in an induction field generated by high frequency (radio frequency) for activation of the process gas.

7. The arrangement according to claim 6, wherein for the purpose of activation of the process gas the discharge chamber is provided with two H-F electrodes which are arranged along the wall of the discharge chamber in the direction of flow of the process gas and which are operated at radio frequency.

8. The arrangement according to claim 6, wherein the discharge chamber is arranged in a coil operated at high frequency for activation of the process gas.

9. The arrangement according to claim 1, wherein the discharge chamber is arranged in a waveguide connected to a microwave source for activation of the process gas.

10. The arrangement according to claim 1, wherein a jet-shaping device is arranged following the limiting channel for adjusting the active gas jet with the desired parameters, particularly velocity, temperature, geometric shape and type of flow.

11. The arrangement according to claim 10, wherein branched nozzles are connected to the output of the limiting channel for treating individual partial surfaces or depressions in the surface to be treated.

12. The arrangement according to claim 10, wherein the jet-shaping device is adapted to the shape of the surface to be treated by means of guiding plates, and the distance between the surface and the guiding plates is kept within a defined small range, so that the effectively treated surface covers a larger area.

13. The arrangement according to claim 10, wherein jet-shaping devices are provided which integrate two or more of the inventive arrangements for generating the active gas jet in one treatment channel, wherein, with continuous throughput of material, a plurality of workpiece surfaces to be treated can be treated simultaneously in the treatment channel or surfaces of continuous sections with a desired cross section can be treated on all sides in the treatment channel.

14. The arrangement according to claim 1, wherein a feed pipe which ends shortly before the output of the discharge chamber is arranged axially in the discharge chamber for introducing additives in the active gas jet, wherein additives are prevented from influencing the discharge characteristic and the additives or their reaction products are prevented from contaminating the discharge chamber.

15. The arrangement according to claim 1, wherein the limiting channel comprises a plurality of individual channels in order to reduce the gas-dynamic resistance and the dwell time of the active gas in the limiting channel, wherein the individual channels are arranged so as to be uniformly distributed in a ring around a central channel.

16. The arrangement according to claim 15, wherein the limiting channel with a plurality of individual channels has a central feed channel for additives, wherein the feed channel is arranged axially in the center of the ring of individual channels through which activated process gas flows.

17. The arrangement according to claim 14, wherein the additives can be introduced into the area of the limiting channel as gases, liquids in the form of aerosols or solids in the form of fine particles.

18. The arrangement according to claim 4, wherein the hollow electrode, the limiting channel and the jet-shaping device are manufactured as an individual rotating body with very good electrical conductivity, the center electrode is introduced into the discharge chamber formed by the hollow electrode as a rod-shaped center electrode enclosed coaxially by an insulating pipe, and the gas feed for the process gas has tangential flow channels in a cylindrical distribution chamber enclosed concentrically by the center electrode, wherein arc discharges between the center electrode and hollow electrode have a concentrated outlet area on the end of the center electrode due to the resulting spiral-shaped gas flow from the distribution chamber into the discharge chamber.

19. The arrangement according to claim 18, wherein tangential flow channels are guided into a cylindrical, annular portion of the discharge chamber between the inner surface of the hollow electrode and the outer surface of the insulating pipe, so that the process gas circulates externally around the insulating pipe in a spiral-shaped manner.

20. The arrangement according to claim 18, wherein tangential flow channels are guided, in addition, into a cylindrical, annular chamber between the rod-shaped center electrode and the inner surface of the insulating pipe, so that the center electrode is cooled directly by a proportion of the process gas and outlet points of arc discharges are substantially confined to noncylindrical surfaces of the center electrode.

21. The arrangement according to claim 18, wherein the end of the rod-shaped center electrode protrudes over the insulating pipe by a length of up to twice the diameter of the center electrode.

22. The arrangement according to claim 19, wherein the end of the center electrode terminates with the end of the insulating pipe.

23. The arrangement according to claim 18, wherein the limiting channel is slightly conically narrowed in the direction of gas flow and has an average ratio of channel diameter to channel length of 1:8.

24. The arrangement according to claim 18, wherein a jet-shaping device with an outlet that widens in a bell-shaped manner adjoins the limiting channel, so that the working width of the active gas jet is increased.

25. An arrangement for treatment of surfaces using chemically active gas jet generated by a plasma generated by electric discharge in a utilized process gas, comprising:

a cylindrical discharge chamber through which a process gas flows and in which plasma is generated by an electric gas discharge to generate an active gas jet;

a gas inlet for continuously feeding the process gas into the discharge chamber;

a jet shaping device for directing the active gas jet to a surface to be treated, the jet shaping device being electrically isolated from the cylindrical discharge chamber;

said discharge chamber having a conically narrowed end for increasing the velocity of the active gas jet;

a limiting channel interposed between the narrowed end of the discharge chamber and the jet shaping device, and preventing propagation of the discharge zone into the free space for the surface to be treated;

said limiting channel being generally cylindrical and being grounded and having the ratio of length to cross section in the range of 5:1 and 10:1.

26. The arrangement according to claim 25, wherein an arc discharge is provided for activating the process gas, wherein the discharge chamber has a center electrode and a hollow electrode that covers the inner wall of the discharge chamber in a planar and symmetrical manner at least in the area of the conically narrowed end.

* * * * *